US006767861B2

(12) United States Patent
Shimada

(10) Patent No.: US 6,767,861 B2
(45) Date of Patent: Jul. 27, 2004

(54) HEAT-SENSITIVE RECORDING MATERIAL

(75) Inventor: Hirokazu Shimada, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 288 days.

(21) Appl. No.: 10/101,284

(22) Filed: Mar. 20, 2002

(65) Prior Publication Data

US 2003/0008775 A1 Jan. 9, 2003

(30) Foreign Application Priority Data

Mar. 26, 2001 (JP) ..... 2001-087496

(51) Int. Cl.[7] ..... B41M 5/40
(52) U.S. Cl. ..... 503/200; 503/226
(58) Field of Search ..... 503/200, 226

(56) References Cited

U.S. PATENT DOCUMENTS 5,021,398 A 6/1991 Sharma et al.

FOREIGN PATENT DOCUMENTS

| | | |
|---|---|---|
| JP | 63-179789 | 7/1988 |
| JP | 8-118808 | 5/1996 |
| JP | 9-193555 | 7/1997 |
| JP | 2000-118133 | 4/2000 |

*Primary Examiner*—Bruce H. Hess
(74) *Attorney, Agent, or Firm*—Sughrue Mion, PLLC

(57) ABSTRACT

A heat-sensitive recording material comprising a heat-sensitive recording layer and a protective layer on a support, wherein the protective layer contains an acetylene glycol represented by the following formula (1):

Formula (1)

Wherein; $R^1$ to $R^4$ respectively represents a hydrogen atom, a branched, straight-chain or cyclic unsubstituted or substituted alkyl group having 1 to 8 carbon atoms or an unsubstituted or substituted aryl group having 6 to 10 carbon atoms; $R^5$ to $R^8$ respectively represents a hydrogen atom or a methyl group; and n and m independently denotes an integer from 0 to 50.

17 Claims, No Drawings

HEAT-SENSITIVE RECORDING MATERIAL

BACKGROUND OF THE INVENTION

1. Field of the Invention

The present invention relates to a heat-sensitive recording material, and, particularly to a heat-sensitive material which comprises a heat-sensitive recording layer and a protective layer on a support and a uniform coating.

2. Description of Related Art

Heat-sensitive recording has been developed in recent years because heat-sensitive recording devices are simple, highly reliable and require no maintenance. As heat-sensitive recording materials used for the heat-sensitive recording, for example, heat-sensitive recording materials which use a reaction between an electron-donating colorless dye and an electron-acceptable compound and those which use a reaction between a diazonium salt compound and a coupler are widely known.

In these conventional heat-sensitive recording materials, surface defects (coating nonuniformities) caused by the repulsion of a protective layer by a heat-sensitive recording layer occur at a certain rate.

SUMMARY OF THE INVENTION

An object of the present invention is to provide a heat-sensitive recording material having reduced coating nonuniformities.

The inventors of the present invention have conducted earnest studies to attain the above object and, as a result, found that it is effective to add a specific surfactant to a protective layer, thus completing the present invention.

Accordingly, the present invention provides a heat-sensitive recording material comprising a heat-sensitive recording layer and a protective layer on a support, wherein the protective layer contains an acetylene glycol represented by the following formula (1):

Formula (1)

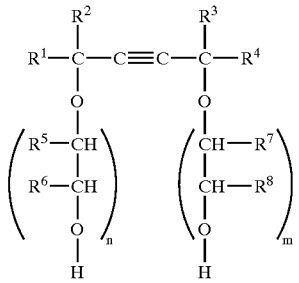

wherein: $R^1$ to $R^4$ respectively represents a hydrogen atom, a branched, straight-chain or cyclic unsubstituted or substituted alkyl group having 1 to 8 carbon atoms or an unsubstituted or substituted aryl group having 6 to 10 carbon atoms; $R^5$ to $R^8$ respectively represents a hydrogen atom or a methyl group; and n and m independently denotes an integer from 0 to 50.

DETAILED DESCRIPTION OF THE PREFERRED EMBODIMENTS

Preferred embodiments of a heat-sensitive recording material according to the present invention will be explained hereinafter.

The heat-sensitive recording material of the present invention is provided with a heat-sensitive recording layer and a protective layer on a support. The protective layer contains at least an acetylene glycol represented by the following formula (1):

Formula (1)

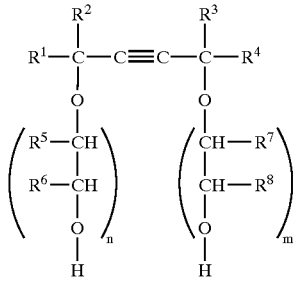

In the above formula, n and m denote integers from 0 to 50 and preferably integers from 0 to 4.

Also, $R^1$ to $R^4$ respectively represent a hydrogen atom, a branched, straight-chain or cyclic unsubstituted or substituted alkyl group having 1 to 8 carbon atoms or an unsubstituted or substituted aryl group having 6 to 10 carbon atoms. Specific examples of the alkyl groups include a methyl group, ethyl group, n-propyl group, isopropyl group, n-butyl group, isobutyl group and cyclohexyl group. Specific examples of the aryl group include a phenyl group and naphthyl group. Examples of the substituent include an ether group and ester group.

It is preferable that $R^2$ and $R^3$ respectively be a methyl group, $R^1$ and $R^4$ respectively be an isobutyl group among these groups and n and m respectively be 0.

$R^5$ to $R^8$ respectively represents hydrogen atom or a methyl group.

Specific examples of the acetylene glycol represented by the formula (1) will be given below; however, these examples are not intended to limit the present invention.

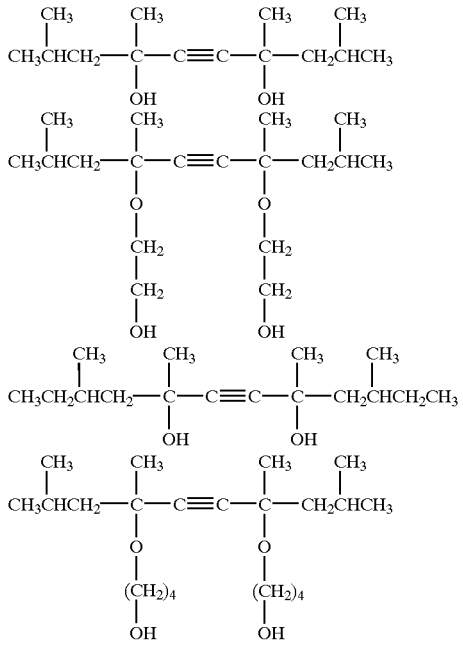

-continued

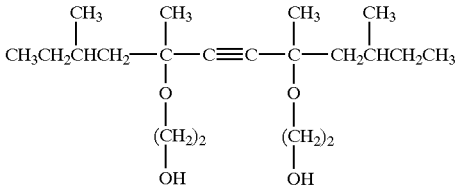

Other Components

In addition to the aforementioned surfactant, the protective layer comprises binders, pigments, lubricants, dispersants, fluorescent whitening agents, metal soaps, hardeners, ultraviolet absorbers, crosslinking agents and the like.

Examples of the above binder include water-soluble polymers such as vinyl acetate-acrylamide copolymers, silicon-modified polyvinyl alcohol, starch, denatured starch, methyl cellulose, carboxymethyl cellulose, hydroxymethyl cellulose, gelatins, gum arabic, casein, styrene-maleic acid copolymer hydrolysate, styrene-maleic acid copolymer half ester hydrolysate, isobutylene-maleic acid anhydride copolymer hydrolysate, polyacrylamide derivatives, polyvinylpyrrolidone, sodium polystyrenesulfonate and sodium alginate and synthetic rubber latexes and synthetic resin emulsions such as styrene-butadiene rubber latex, acrylonitrile-butadiene rubber latex, methyl acrylate-butadiene rubber latex and vinyl acetate emulsion.

Among the above binders, polyvinyl alcohol or its derivatives are preferable. Specific examples of these compounds are described in Japanese Patent Application Laid-Open (JP-A) No. 2000-118133.

Examples of the aforementioned pigments are not particularly limited, and include, kaolin, baked kaolin, talc, agalmatolite, diatomaceous earth, calcium carbonate, aluminum hydroxide, magnesium hydroxide, zinc oxide, lithopone, amorphous silica, colloidal silica, baked gypsum, silica, magnesium carbonate, titanium oxide, alumina, barium carbonate, barium sulfate, mica, microballoon, urea-formalin filler, polyester particle and cellulose filler.

The content of the aforementioned binder is preferably 10 to 500 wt % and more preferably 50 to 400 wt % relative to the pigment in the protective layer.

It is effective to use a crosslinking agent and a catalyst that promotes the reaction of the crosslinking agent together to improve the water resistance. Examples of the crosslinking agent include an epoxy compound, blocked isocyanate, vinylsulfone compound, aldehyde compound, methylol compound, boric acid, carboxylic acid anhydride, silane compound, chelate compound and halogen compound. Among these compounds, those able to adjust the pH of a coating solution for a protective layer to be from 5.5 to 9.5 are preferable. Examples of the catalyst include known acids and metal salts, and, like the above, those able to adjust the pH of a coating solution for a protective layer to be from 5.5 to 9.5 are preferable.

Preferable examples of the lubricant include zinc stearate, calcium stearate, paraffin wax and polyethylene wax.

The protective layer may contain other surfactant. Preferable examples of the other surfactant include those which contain fluorine.

A coating solution for forming the protective layer (coating solution for a protective layer) is obtained by mixing each of the aforementioned components. A mold releasing agent, wax, water repellent agent and the like may also be added according to the need.

The dry coating amount of the protective layer is preferably 0.2 to 7 g/m and more preferably 1 to 4 g/m$^2$ If the dry coating amount is less than 0.2 g/m$^2$, then the water resistance might not be maintained. Conversely, if the amount exceeds 7 g/m$^2$, then the heat sensitivity might be significantly decreased. After the protective layer is formed by application, a calendering treatment may be carried out according to the need.

Heat-sensitive Recording Layer

The heat-sensitive recording layer comprises color developing components and may also comprise other components such as a binder and a base according to the need. Preferable examples of the aforementioned color developing component include (1) a combination of a diazonium salt compound and a coupler which has a coupling reaction with the diazonium salt compound to form a color and (2) a combination of an electron-donating dye precursor and an electron-acceptable compound which reacts with the electron-donating dye precursor to form a color.

Diazonium Salt Compound

Examples of the aforementioned diazonium salt compound are compounds represented by the following formula (2).

$$Ar—N_2^+X^- \quad (2)$$

wherein Ar represents a portion of an aromatic group and $X^-$ represents an acid anion.

The diazonium salt compound is a compound which has a coupling reaction with a coupler, the coupler to be explained later, when heated to form a color and which is decomposed by light. The maximum absorption wavelength of each of these compounds can be controlled by the position and type of substituent of the Ar.

Specific examples of diazoniums forming salts include 4-(p-tolylthio)-2,5-dibutoxybenzenediazonium, 4-(4-chlorophenylthio)-2,5-dibutoxybenzenediazonium, 4-(N,N-dimethylamino)benzenediazonium, 4-(N,N-diethylamino) benzenediazonium, 4-(N,N-dipropylamino) benzenediazonium, 4-(N-methyl-N-benzylamino) benzenediazonium, 4-(N,N-dibenzylamino) benzenediazonium, 4-(N-ethyl-N-hydroxyethylamino) benzenediazonium, 4-(N,N-diethylamino)-3-methoxybenzenediazonium, 4-(N,N-dimethylamino)-2-methoxybenzenediazonium, 4-(N-benzoylamino)-2,5-diethoxybenzenediazonium, 4-morpholino-2,5-dibutoxybenzenediazonium, 4-anilinobenzenediazonium, 4-[N-(4-methoxybenzoyl)amino]-2,5-diethoxybenzenediazonium, 4-pyrrolidino-3-ethylbenzenediazonium, 4-[N-(1-methyl-2-(4-methoxyphenoxy)ethyl)-N-hexylamino]-2-hexyloxybenzenediazonium, 4-[N-(2-(4-methoxyphenoxy) ethyl)-N-hexylamino]-2-hexyloxybenzenediazonium, 2-(1-ethylpropyloxy)-4-[di-(di-n-butylaminocarbonylmethyl) amino]benzenediazonium and 2-benzylsulfonyl-4-[N-methyl-N-(2-octanoyloxyethyl)]aminobenzenediazonium.

The maximum absorption wavelength λmax of the aforementioned diazonium salt compound is preferably 450 nm or less and more preferably 290 to 440 nm. When the above λmax exceeds 450 nm, a raw stock storability may decrease whereas when the above λmax is shorter than the above wavelength range, an image fixing ability and an image preserving ability in the combinations with a coupler, to be explained later, may be decreased and a hue of the developed cyan color may become inferior.

Also, it is desirable that the diazonium salt compound have 12 or more carbon atoms, a solubility of 1% or less in water and a solubility of 5% or more in an ethyl acetate.

These diazonium salt compounds may be used either singly or in combinations of two or more corresponding to the purpose, such as the adjustment of hues.

Among the above diazonium salt compounds, diazonium salt compounds represented by the following structural formulae (1) to (3) are preferable in view of the hue of dyes, image preserving ability and image fixing ability.

Structural formula (1)

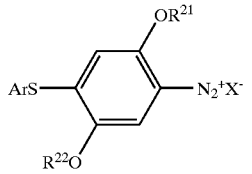

Structural formula (2)

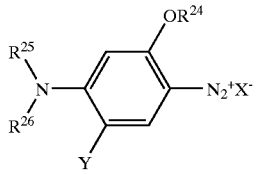

Structural formula (3)

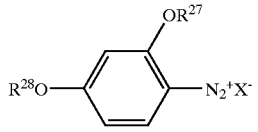

In the above structural formula (1), Ar represents a substituted or unsubstituted aryl group.

Examples of the substituent include an alkyl group, alkoxy group, alkylthio group, aryl group, aryloxy group, arylthio group, acyl group, alkoxycarbonyl group, carbamoyl group, carboamide group, sulfonyl group, sulfamoyl group, sulfonamide group, ureide group, halogen atom, amino group and heterocyclic group. These substituents may be further substituted.

As the aryl group represented by the aforementioned Ar, aryl groups having 6 to 30 carbon atoms are preferable. Examples of the aryl group include: a phenyl group, 2-methylphenyl group, 2-chlorophenyl group, 2-methoxyphenyl group, 2-butoxyphenyl group, 2-(2-ethylhexyloxy)phenyl group, 2-octyloxyphenyl group, 3-(2,4-di-t-pentylphenoxyethoxy)phenyl group, 4-chlorophenyl group, 2,5-dichlorophenyl group, 2,4,6-trimethylphenyl group, 3-chlorophenyl group, 3-methylphenyl group, 3-methoxyphenyl group, 3-butoxyphenyl group, 3-cyanophenyl group, 3-(2-ethylhexyloxy)phenyl group, 3,4-dichlorophenyl group, 3,5-dichlorophenyl group, 3,4-dimethoxyphenyl group, 3-(dibutylaminocarbonylmethoxy) phenyl group, 4-cyanophenyl group, 4-methylphenyl group, 4-methoxyphenyl group, 4-butoxyphenyl group, 4-(2-ethylhexyloxy)phenyl group, 4-benzylphenyl group, 4-aminosulfonylphenyl group, 4-N,N-dibutylaminosulfonylphenyl group, 4-ethoxycarbonylphenyl group, 4-(2-ethylhexylcarbonyl) phenyl group, 4-fluorophenyl group, 3-acetylphenyl group, 2-acetylaminophenyl group, 4-(4-chlorophenylthio)phenyl group, 4-(4-methylphenyl)thio-2,5-dibutoxyphenyl group and 4-(N-benzyl-N-methylamino)-2-dodecyloxycarbonylphenyl group. However, these groups are not intended to limit the present invention.

These groups maybe substituted with an alkyloxy group, alkylthio group, substituted phenyl group, cyano group, substituted amino group, halogen atom, heterocyclic group or the like.

$R^{21}$ and $R^{22}$ in the above structural formula (1) respectively represent a substituted or unsubstituted alkyl group or a substituted or unsubstituted aryl group. $R^{21}$ and $R^{22}$ may be the same or different.

Examples of substituents when the above groups are substituted are, an alkoxy group, alkoxycarbonyl group, alkylsulfonyl group, substituted amino group, substituted amide group, aryl group and aryloxy group; however these groups are not intended to limit the present invention.

As the alkyl group represented by $R^{21}$ or $R^{22}$, alkyl groups having 1 to 18 carbon atoms are preferable. Examples of the alkyl groups include a methyl group, trifluoromethyl group, ethyl group, propyl group, isopropyl group, butyl group, sec-butyl group, t-butyl group, pentyl group, isopentyl group, cyclopentyl group, hexyl group, cyclohexyl group, octyl group, t-octyl group, 2-ethylhexyl group, nonyl group, octadecyl group, benzyl group, 4-methoxybensyl group, triphenylmethyl group, ethoxycarbonylmethyl group, butoxycarbonylmethyl group, 2-ethylhexyloxycarbonylmethyl group, 2',4'-diisopentylphenyloxymethyl group, 2',4'-di-t-butylphenyloxymethyl group, dibenzylaminocarbonylmethyl group, 2,4-di-t-amylphenyloxypropyl group, ethoxycarbonylpropyl group, 1-(2',4'-di-t-amylphenyloxy) propyl group, acetylaminoethyl group, 2-(N,N-dimethylamino)ethyl group, 2-(N,N-diethylamino)propyl group, methanesulfonylaminopropyl group, acetylaminoethyl group, 2-(N,N-dimethylamino) ethyl group and 2-(N,N-diethylamino)propyl group.

As the aryl group represented by $R^{21}$ or $R^{22}$, aryl groups having 6 to 30 carbon atoms are preferable. Examples of the aryl groups include, but are not limited to, a phenyl group, 2-methylphenyl group, 2-chlorophenyl group, 2-methoxyphenyl group, 2-butoxyphenyl group, 2-(2-ethylhexyloxy)phenyl group, 2-octyloxyphenyl group, 3-(2,4-di-t-pentylphenoxyethoxy)phenyl group, 4-chlorophenyl group, 2,5-dichlorophenyl group, 2,4,6-trimethylphenyl group, 3-chlorophenyl group, 3-methylphenyl group, 3-methoxyphenyl group, 3-butoxyphenyl group, 3-cyanophenyl group, 3-(2-ethylhexyloxy)phenyl group, 3,4-dichlorophenyl group, 3, 5-dichlorophenyl group, 3,4-dimethoxyphenyl group, 3-(dibutylaminocarbonylmethoxy) phenyl group, 4-cyanophenyl group, 4-methylphenyl group, 4-methoxyphenyl group, 4-butoxyphenyl group, 4-(2-ethylhexyloxy)phenyl group, 4-benzylphenyl group, 4-aminosulfonylphenyl group, 4-N,N-dibutylaminosulfonylphenyl group, 4-ethoxycarbonylphenyl group, 4-(2-ethylhexylcarbonyl) phenyl group, 4-fluorophenyl group, 3-acetylphenyl group, 2-acetylaminophenyl group, 4-(4-chlorophenylthio)phenyl group, 4-(4-methylphenyl)thio-2,5-butoxyphenyl group and 4-(N-benzyl-N-methylamino)-2-dodecyloxycarbonylphenyl group.

$R^{24}$, $R^{25}$ and $R^{26}$ in the aforementioned structural formula (2) respectively represent a substituted or unsubstituted alkyl group or a substituted or unsubstituted aryl group wherein $R^{24}$, $R^{25}$ and $R^{26}$, may be the same or different.

Examples of a substituent when the above group is substituted are: an alkyl group, alkoxy group, alkylthio group, arylgroup, aryloxygroup, arylthiogroup, acylgroup, alkoxycarbonyl group, carbamoyl group, carboamide group, sulfonyl group, sulfamoyl group, sulfonamide group, ureide group, halogen atom, amino group and heterocyclic group.

As the alkyl group represented by $R^{24}$, $R^{25}$ or $R^{26}$, alkyl groups having 1 to 18 carbon atoms are preferable. Examples of these alkyl groups include the examples of the alkyl groups represented by $R^{21}$ or $R^{22}$ in the structural formula (1), 1-methyl-2-(4-methoxyphenoxy)ethyl group, di-n-butylaminocarbonylmethyl group and di-n-octylaminocarbonylmethyl group.

The aryl groups which are represented by $R^{24}$, $R^{25}$ or $R^{26}$ are the same as the aryl groups which can be represented by $R^{21}$ or $R^{22}$ in the above structural formula (1). However, these examples are not intended to limit the present invention.

These groups may be further substituted with an alkyloxy group, alkylthio group, substituted phenyl group, cyano group, substituted amino group, halogen atom or heterocyclic group.

In the aforementioned structural formula (2), Y represents a hydrogen atom or an $OR^{23}$ group, wherein $R^{23}$ represents a substituted or unsubstituted alkyl group or a substituted or unsubstituted aryl group.

Examples of a substituent when the above group is substituted are an alkyl group, alkoxy group, alkylthio group, aryl group, aryloxy group, arylthio group, acyl group, alkoxycarbonyl group, carbamoyl group, carboamide group, sulfonyl group, sulfamoyl group, sulfonamide group, ureide group, halogen atom, amino group and heterocyclic group.

Among the above examples of Y, a hydrogen atom or an alkyloxy group wherein $R^{23}$ is an alkyl group is preferable for hue adjustment.

The alkyl groups which can be represented by above $R^{23}$ are the same as the alkyl groups which can be represented by $R^{21}$ or $R^{22}$ in the structural formula (1). However, these examples are not intended to limit the present invention.

The aryl groups which can be represented by $R^{23}$ are the same as the aryl groups which can be represented by $R^{21}$ or $R^{22}$. However, these examples are not intended to limit the present invention. These aryl groups may be further substituted with an alkyloxy group, alkylthio group, substituted phenyl group, cyano group, substituted amino group, halogen atom or heterocyclic group.

$R^{27}$ and $R^{28}$ in the structural formula (3) respectively represent a substituted or unsubstituted alkyl group or a substituted or unsubstituted aryl group wherein $R^{27}$ and $R^{28}$ may be the same or different.

Examples of a substituent when the above group is substituted are: an alkyl group, alkoxy group, alkylthio group, arylgroup, aryloxygroup, arylthiogroup, acylgroup, alkoxycarbonyl group, carbamoyl group, carboamide group, sulfonyl group, sulfamoyl group, sulfonamide group, ureide group, halogen atom, amino group and heterocyclic group.

The alkyl groups which can be represented by $R^{27}$ or $R^{28}$ are the same as the alkyl groups which can be represented by $R^{21}$ or $R^{22}$ in the above structural formula (1). However, these examples are not intended to limit the present invention.

The aryl groups which can be represented by $R^{27}$ or $R^{28}$ are the same as the aryl groups which can be represented by $R^{21}$ or $R^{22}$ in the above structural formula (1). However, these examples are not intended to limit the present invention. These aryl groups may be further substituted with an alkyloxy group, alkylthio group, substituted phenyl group, cyano group, substituted amino group, halogen atom or heterocyclic group.

In the structural formulae (1) to (3), $X^-$ represents an acid anion. Examples of the acid anion include polyfluoroalkylcarboxylic acid having 1 to 9 carbon atoms, polyfluoroalkylsulfonic acid having 1 to 9 carbon atoms, boron tetrafluoride, tetraphenylboron, hexafluorophosphoric acid, aromatic carboxylic acid and aromatic sulfonic acid. Among these compounds, hexafluorophosphoric acid is preferable in view of crystallinity.

Specific examples of the diazonium salt compounds represented by the structural formulae (1) to (3) will be shown below; however these examples are not intended to limit the present invention.

(1)-1

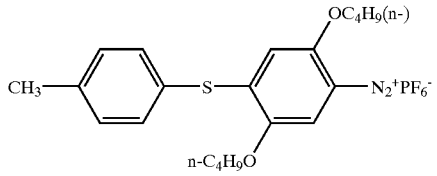

(1)-2

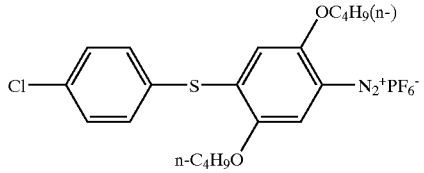

(1)-3

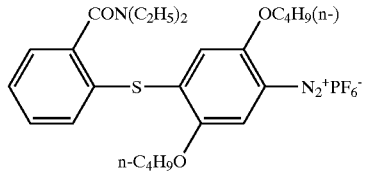

(1)-4

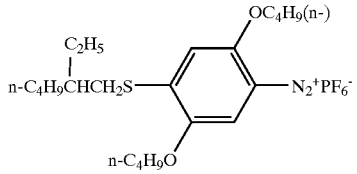

(2)-1

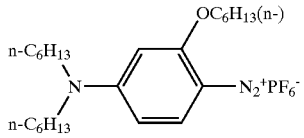

(2)-2

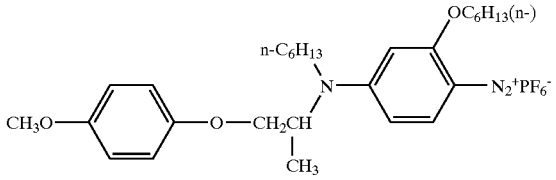

(2)-3

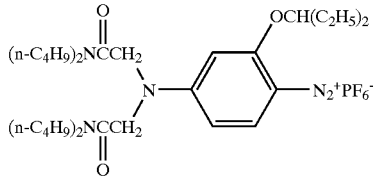

(2)-4

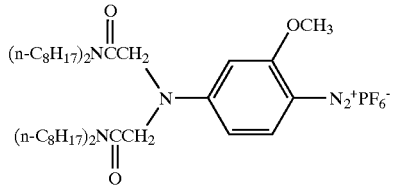

-continued (2)-5

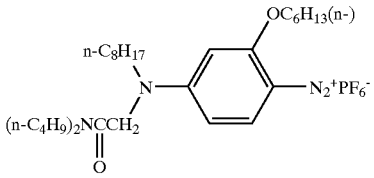

(2)-6

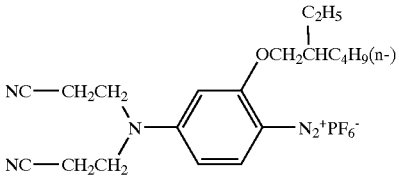

(2)-7

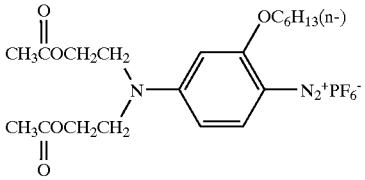

(2)-8

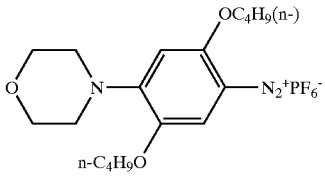

(2)-9

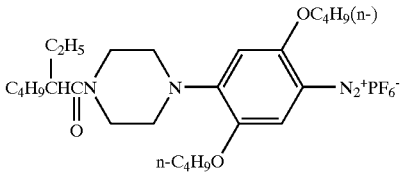

(2)-10

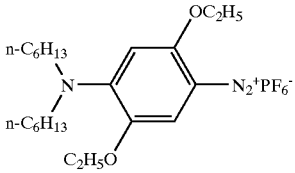

(3)-1

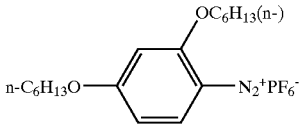

The diazonium salt compounds represented by the structural formulae (1) to (3) may be used either singly or in combinations of two or more. Each of the diazonium salt compounds represented by the structural formulae (1) to (3) may also be used in combination with other existing diazonium salt compounds in accordance with various objectives such as the adjustment of hues.

The amount of the above diazonium salt compound to be coated is preferably 0.05 to 2 g/m$^2$ and more preferably 0.1 to 1 g/m$^2$ in the heat-sensitive recording layer. When the content is less than 0.05 g/m$^2$, sufficient color developing density may not be obtained whereas when the content exceeds 2 g/m$^2$, coating qualities of the coating solution may become inferior.

Coupler

As the coupler compound which forms a color by having a coupling reaction with the diazonium salt compound and forming a dye, any compound may be used as long as it couples with the diazonium compound under a basic atmosphere and/or a neutral atmosphere.

Any of the so-called 4 equivalent couplers used by a silver halide photographic light-sensitive material may be used as the coupler and an appropriate coupler can be selected in accordance with the objectives such as target hues. Examples of the coupler include so-called active methylene compounds having a methylene group adjacent to a carbonyl group, phenol derivatives and naphthol derivatives.

Among these compounds, compounds represented by the following formula (3) or tautomers of the compounds are particularly preferable.

$$E^1—CH_2—E^2 \quad (3)$$

In the formula (3) $E^1$ and $E^2$ respectively represent an electron attractive group and may be the same or different.

The electron attractive group means substituents for which the Hammett $\alpha$ value is positive. Examples of the electron attractive group include: acyl groups such as an acetyl group, propionyl group, pivaloyl group, chloroacetyl group, trichloroacetyl group, trifluoroacetyl group, 1-methylcyclopropylcarbonyl group, 1-ethylcyclopropylcarbonyl group, 1-benzylcyclopropylcarbonyl group, benzoyl group, 4-methoxybenzoyl group and thenoyl group; alkoxycarbonyl groups such as a methoxycarbonyl group, ethoxycarbonyl group, 2-methoxyethoxycarbonyl group and 4-methoxyphenoxycarbonyl group; carbamoyl groups such as a carbamoyl group, N,N-dimethylcarbamoyl group, N,N-diethylcarbamoyl group, N-phenylcarbamoyl group, N-[2,4-bis(pentyloxy)phenyl]carbamoyl group, N-[2,4-bis(octyloxy)phenyl]carbamoyl group and morpholinocarbonyl group; alkylsulfonyl groups or arylsulfonyl group such as methanesulfonyl group, benzenesulfonyl group and toluenesulfonyl group; phosphono groups such as diethylphosphono group; heterocyclic groups such as a benzoxazole-2-yl group, benzothiazole-2-yl group, 3,4-dihydroquinazolin-4-one-2-yl group and 3,4-dihydroquinazoline-4-sulfone-2-yl group: a nitro group, an imino group and a cyano group.

$E^1$ and $E^2$ may be combined to form a ring. As the ring formed by $E^1$ and $E^2$, five-or six-membered carbon rings or heterocyclic rings are preferable.

Specific examples of the aforementioned coupler include resorcin, fluoroglucin, 2,3-dihydroxynaphthalene, sodium 2,3-dihydroxynaphthalene-6-sulfonate, 1-hydroxy-2-naphthoenic acid morpholinopropylamide, sodium 2-hydroxy-3-naphthalenesulfonate, 2-hydroxy-3-naphthalenesulfonic acid anilide, 2-hydroxy-3-naphthalenesulfonic acid molpholinopropylamide, 2-hydroxy-3-naphthalenesulfonic acid-2-ethylhexyloxypropylamide, 2-hydroxy-3-naphthalenesulfonic acid-2-ethylhexylamide, 5-acetamido-1-naphthol, sodium 1-hydroxy-8-acetamidonaphthalene-3,6-disulfonate, 1-hydroxy-8-acetamidonaphthalene-3,6-disulfonic acid dianilide, 1,5-dihydroxynaphthalene, 2-hydroxy-3-naphthenic acid morpholinopropylamide, 2-hydroxy-3-naphthoenic acid octylamide, 2-hydroxy-3-naphthoenic acid anilide, 5,5-dimethyl-1,3-cyclohexanedione, 1,3-cyclopentanedione, 5-(2-n-tetradecyloxyphenyl)-1,3-cyclohexanedione, 5-phenyl-4-methoxycarbonyl-1,3-cyclohexanedione, 5-(2,5-di-n-octyloxyphenyl)-1,3-cyclohexanedione, N,N'-dicyclohexylbarbituric acid, N,N'-di-n-dodecylbarbituric acid, N-n-octyl-N'-n-octadecylbarbituric acid, N-phenyl-N'-(2,5-di-n-octyloxyphenyl)barbituric acid, N,N'-bis(octadecyloxycarbonylmethyl)barbituric acid, 1-phenyl-3-methyl-5-pyrazolone, 1-(2,4,6-trichlorophenyl)-3-anilino-5-pyrazolone, 1-(2,4,6-trichlorophenyl)-3-benzamido-5-pyrazolone, 6-hydroxy-4-methyl-3-cyano-1-(2-ethylhexyl)-2-pyridone, 2,4-bis-(benzoylacetamide)toluene, 1,3-bis-(pivaloylacetamidomethyl)benzene, benzoylacetonitrile, thenoylacetonitrile, acetoanilide, benzoylacetoanilide, pivaloylacetoanilide, 2-chloro-5-(N-n-butylsulfamoyl)-1-pivaloylacetamidobenzene, 1-(2-ethylhexyloxypropyl)-3-cyano-4-methyl-6-hydroxy-1,2-dihydropyridin-2-one, 1-(dodecyloxypropyl)-3-acetyl-4-methyl-6-hydroxy-1,2-dihydropyridin-2-one and 1-(4-n-octyloxyphenyl)-3-tert-butyl-5-aminopyrazole.

The details of the aforementioned coupler are described in JP-A Nos. 4-201483, 7-223367, 7-223368, 7-323660 and Japanese Patent Application Nos. 5-278608, 5-297024, 6-18669, 6-18670, 7-316280, 8-027095, 8-027096, 8-030799, 8-12610, 8-132394, 8-358755, 8-358756 and 9-069990.

Specific examples of the coupler represented by the above structural formulae (3) will be shown below; however these examples are not intended to limit the present invention.

B-1

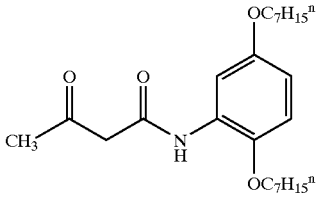

B-2

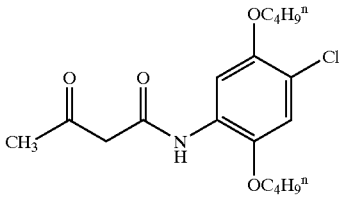

B-3

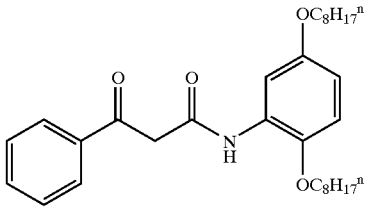

B-4

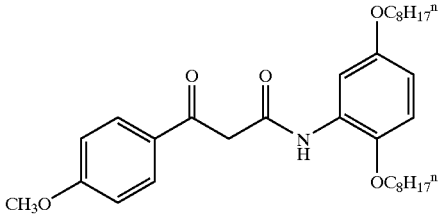

-continued

B-5

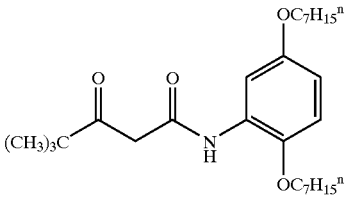

B-6

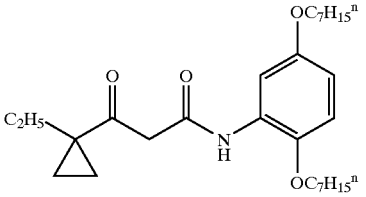

B-7

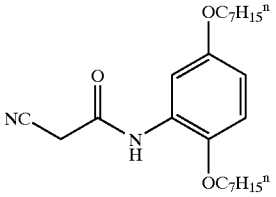

B-8

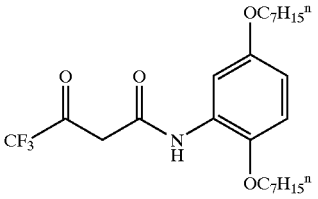

B-9

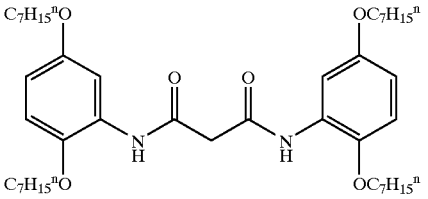

B-10

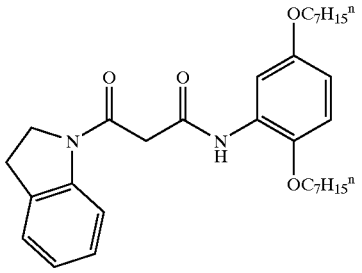

-continued
B-11
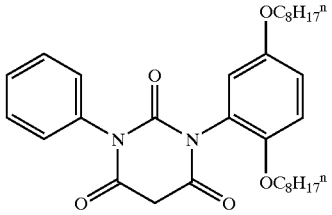
B-12
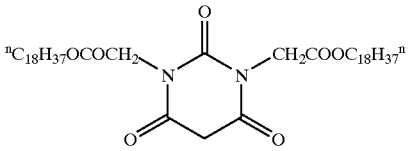
B-13
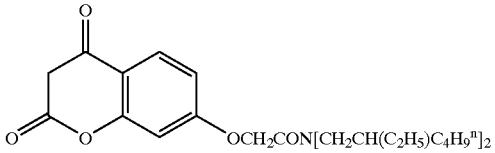
B-14
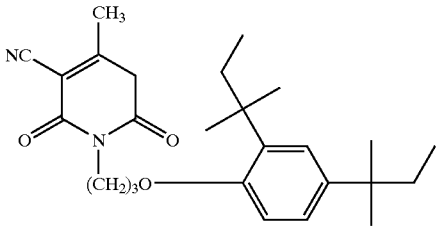
B-15
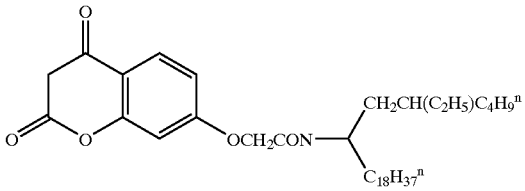
B-16
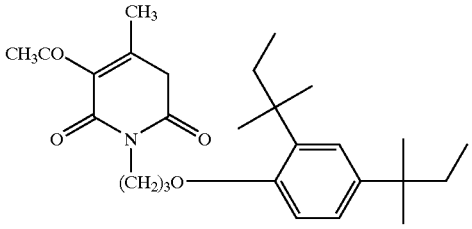
B-17
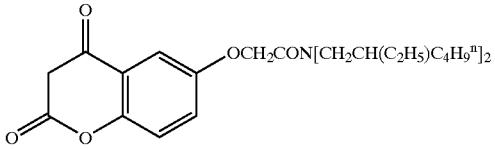
-continued
B-18
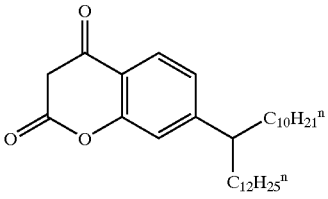
B-19
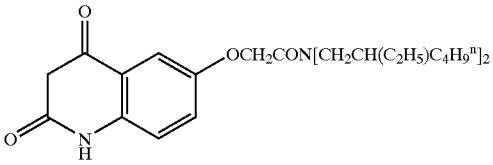
B-20
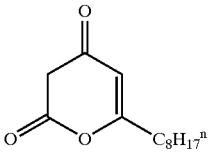
B-21
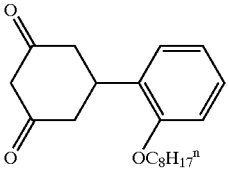
B-22
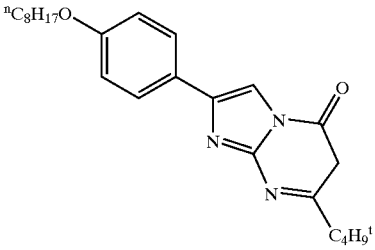
B-23
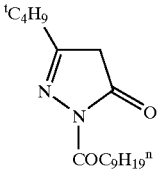
B-24
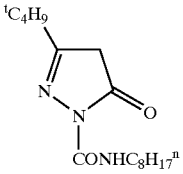

-continued

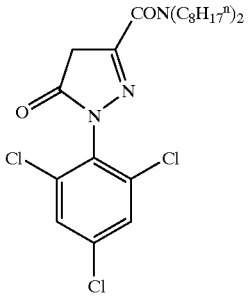

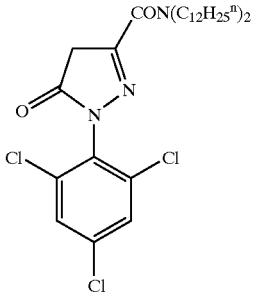

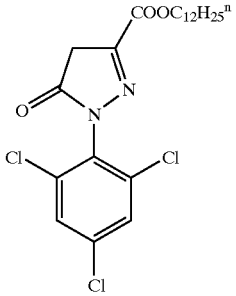

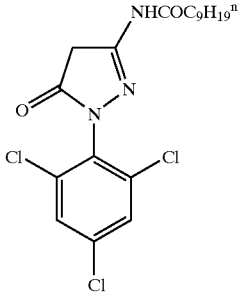

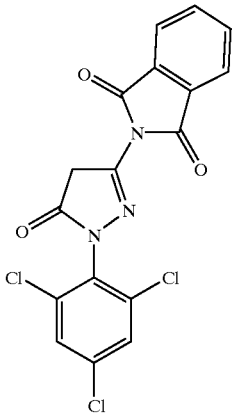

-continued

B-25

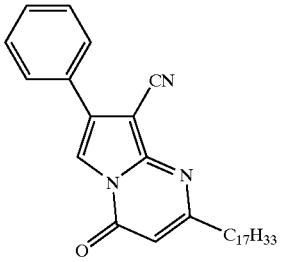

B-30

B-26 The content of the coupler in the heat-sensitive recording layer is preferably 0.1 to 30 parts by weight relative to 1 part by weight of the diazonium salt compound.

In the heat-sensitive recording material of the present invention, besides the combination of the diazonium salt compound and coupler (diazo type color developing agent), a combination of an electron-donating dye precursor and an electron-acceptable compound (leuco type color developing agent) may be used. For example, a heat-sensitive recording material which comprises multiple heat-sensitive recording layers on a support may be structured so that at least one layer among these recording layers includes a leuco type color developing agent.

B-27 Electron-donating Dye Precursor

Examples of the aforementioned electron-donating dye precursor include triarylmethane compounds, diphenylmethane compounds, thiazine compounds, xanthene compounds and spiropyran compounds. Among these compounds, triarylmethane compounds and xanthene compounds are preferable in that these compounds have high color developing density.

B-28 The following compounds are given as specific examples of these compounds. Namely, these examples include 3,3-bis(p-dimethylaminophenyl)-6-dimethylaminophthalide (namely, crystal violet lactone), 3,3-bis(p-dimethylamino) phthalide, 3-(p-dimethylaminophenyl)-3-(1,3-dimethylindole-3-yl)phthalide, 3-(p-dimethylaminophenyl)-3-(2-methylindole-3-yl)phthalide, 3-(o-methyl-p-diethylaminophenyl)-3-(2-methylindole-3-yl)phthalide, 4,4'-bis(dimethylamino)benzhydrinbenzyl ether, N-halophenylleucoauramine, N-2,4,5-trichlorophenylleucoauramine, rhodamine-B-anilinolactam, rhodamine(p-nitroanilino)lactam, rhodamine-B-(p-chloroanilino)lactam, 2-benzylamino-6-diethylaminofluoran, 2-anilino-6-diethylaminofluoran, 2-anilino-3-methyl-6-diethylaminofluoran, 2-anilino-3-methyl-6-cyclohexylmethylaminofluoran, 2-anilino-3-methyl-6-isoamylethylaminofluoran, 2-(o-chloroanilino)-6-e thylaminofluoran, 2-octylamino-6-ethylaminofluoran, 2-ethoxyethylamino-3-chloro-2-ethylaminofluoran, 2-anilino-3-chloro-6-ethylaminofluoran, benzoylleucomethylene blue, p-nitrobenzylleucomethylene blue, 3-methyl-spiro-dinaphthopyran, 3-ethyl-spiro-dinaphthopyran, 3,3'-dichloro-spiro-dinaphthopyran, 3-benzyl-spiro-dinaphthopyran and 3-propyl-spiro-dibenzopyran.

B-29 The amount of the above electron-donating dye precursor to be coated in the heat-sensitive recording layer is preferably 0.1 to 1 g/m$^2$ for the same reasons as in the case of the foregoing diazonium salt compound.

Electron-acceptable Compound

Examples of the aforementioned electron-acceptable compound include phenol derivatives, salicylic acid derivatives and hydroxybenzoate. Among these compounds, bisphenols and hydroxybenzoates, in particular, are preferable. The following compounds are given as specific examples.

Specifically, these examples include: 2,2-bis(p-hydroxyphenyl)propane (namely, bisphenol A), 4,41-(p-phenylenediisopropylidene)diphenol (namely, bisphenol P), 2,2-bis(p-hydroxyphenyl)pentane, 2,2-bis(p-hydroxyphenyl)ethane, 2,2-bis(p-hydroxyphenyl)butane, 2,2-bis(4'-hydroxy-3',5'-dichlorophenyl)propane, 1,1-bis(p-hydroxyphenyl)cyclohexane, 1,1-bis(p-hydroxyphenyl) propane, 1,1-bis(p-hydroxyphenyl)pentane, 1,1-bis(p-hydroxyphenyl)-2-ethylhexane, 3,5-di(α-methylbenzyl) salicylic acid and its polyvalent metal salts, 3,5-di(tert-butyl) salicylic acid and its polyvalent metal salts, 3-α,α-dimethylbenzylsalicylic acid and its polyvalent metal salts, butyl p-hydroxybenzoate, benzyl p-hydroxybenzoate, 2-ethylhexyl p-hydroxybenzoate, p-phenylphenol and p-cumylphenol.

The content of the electron-acceptable compound in the heat-sensitive recording layer is preferably 0.1 to 30 parts by weight relative to 1 part by weight of the electron-donating dye precursor.

Other Components

Organic Base

In the present invention, it is preferable to add an organic base to promote a coupling reaction between the diazonium salt and the coupler. The organic base is preferably included together with the diazonium salt compound and the coupler in the light-sensitive and heat-sensitive recording layer. The organic bases may be used either singly or in combinations of two or more.

Examples of organic bases include nitrogen-containing compounds such as tertiary amines, piperidines, piperazines, amidines, formamidines, pyridines, guanidines and morpholines. Also, compounds described in the official gazette of Japanese Patent Application Publication (JP-B) No. 52-46806, 2-24916, 2-28479 and the official gazette of JP-A Nos. 62-70082, 57-169745, 60-94381, 57-123086, 58-1347901, 60-49991, 60-165288 and 57-185430 may be used.

Among these compounds, preferable examples include piperazines such as N,N'-bis(3-phenoxy-2-hydroxypropyl) piperazine, N,N-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl-]-piperazine, N-3-(β-naphthoxy)-2-hydroxypropyl-N'-methylpiperazine and 1,4-bis{[3-(N-methylpiperazino)-2-hydroxy] propyloxy}benzene; morpholines such as N-[3-(β-naphthoxy)-2-hydroxy]propylmorpholine, 1,4-bis(3-morpholino-2-hydroxy-propyloxy)benzene and 1,3-bis(3-morpholino-2-hydroxy-propyloxy)benzene; piperidines such as N-(3-phenoxy-2-hydroxypropyl)piperidine and N-dodecylpiperidine; and guanidines such as triphenylguanidine, tricyclohexylguanidine and dicyclohexylphenylguanidine.

When the organic base is included as desired, the content of the organic base in the heat-sensitive recording layer is preferably 0.1 to 30 parts by weight relative to 1 part by weight of the diazonium salt compound.

Sensitizer

Besides the aforementioned organic base, a sensitizer may also be added to the heat-sensitive recording layer to promote a color developing reaction.

The sensitizer is a material which raises the color developing density when thermal recording is performed or lowers the minimum color developing temperature. The sensitizer lowers the melting point of the coupler, organic base or diazonium salt compound and the like and lowers the softening point of a capsule wall thereby making conditions under which it is easy to run the reaction of the diazonium salt compound, organic base, coupler and the like.

Specifically, low-melting point organic compounds having an aromatic group and a polar group in proper amounts in a molecule are preferable. Examples of these organic compounds are benzyl p-benzyloxybenzoate, α-naphthyl benzyl ether, β-naphthyl benzyl ether, phenyl β-naphthoenate, phenyl α-hydroxy-β-naphthoenate, β-naphthol-(p-chlorobenzyl) ether, 1,4-butanediol phenyl ether, 1,4-butanediol-p-methyl phenyl ether, 1,4-butanediol-p-ethyl phenyl ether, 1,4-butanediol-m-methyl phenyl ether, 1-phenoxy-2-(p-tolyloxy)ethane, 1-phenoxy-2-(p-ethylphenoxy)ethane, 1-phenoxy-2-(p-chlorophenoxy) ethane and p-benzylbiphenyl.

Binder

Examples of the binder to be used in the heat-sensitive recording layer are known water-soluble polymer compounds and latexes.

Examples of the above water-soluble polymer compound are: methyl cellulose, carboxymethyl cellulose, hydroxyethyl cellulose, hydroxypropyl cellulose, starch derivatives, casein, gum arabic, gelatin, ethylene-maleic acid anhydride copolymers, styrene-maleic acid anhydride copolymers, polyvinyl alcohol, epichlorohydrin-modified polyamide, isobutylene-maleic anhydride-salicylic acid terpolymers, polyacrylic acid and polyacrylic acid amide and its modified products. Examples of the above latexes include styrene-butadiene rubber latex, methyl acrylate-butadiene rubber latex and vinyl acetate emulsion.

Pigments

Pigments may be included in the heat-sensitive recording layer to adjust the hue.

Known pigments may be used as the pigment whether they are organic or inorganic. Examples of the pigment are kaolin, baked kaolin, talc, a galmatolite, diatomaceous earth, calcium carbonate, aluminumhydroxide, magnesiumhydroxide, zinc oxide, lithopone, amorphous silica, colloidal silica, baked gypsum, silica, magnesium carbonate, titanium oxide, alumina, barium carbonate, barium sulfate, mica, microballoon, urea-formalin filler, polyester particle and cellulose filler.

Antioxidants and the Like

It is also preferable to use, for example, a known antioxidant shown below to improve the fastness of the color developing image against light and heat or to decrease yellowing caused by light in the non-printed portion (non-image portion) after the image is fixed.

Examples of the above antioxidant may include those described in: the official gazette of European Patent Applications Laid Open Nos. 223739A1, 309401A1, 309402A1, 310551A1, 310552A1 and 459416A1; the official gazette of German Patent Application No. 3435443, the official gazette of JP-A Nos. 54-48535, 62-262047, 63-113536, 63-163351, 2-262654, 2-71262, 3-121449, 5-61166 and 5-119449; and U.S. Pat. Nos. 4814262 and 4980275.

In the present invention, there are no particular limitations to the applicable forms of the aforementioned diazonium salt compound, the coupler which reacts with the diazonium salt compound to develop a color when heated, the other components such as the organic base and the sensitizer, electron-donating dye precursor and the electron-acceptable compound. Examples of a method concerning the applicable forms include: (1) a method in which these components are solid-dispersed when used, (2) a method in which these components are emulsion-dispersed when used, (3) a method in which polymer dispersion of these components is performed when these components are used, (4) a method in which latex dispersion of these components is performed when these components are used and (5) a method making use of microcapsulation. Among these methods, the method (5) making use of microcapsulation is preferable from a view point of preservability. Particularly (i) in a color developing system utilizing a reaction between the diazonium salt compound and the coupler, a structure in which the diazonium salt compound is microcapsulated is preferable and (ii) in a color developing system utilizing a reaction between the electron-donating dye precursor and the electron-acceptable compound, a structure in which the electron-donating dye precursor is microcapsulated is preferable.

Process for the Production of a Microcapsule

In the present invention, the aforementioned diazonium salt compound and/or the electron-donating dye precursor are preferably encapsulated in a microcapsule from the view point of improving the storage stability of the heat-sensitive recording material.

As a process of microcapsulating the color developing components, a conventionally known method may be used. For example, an interfacial polymerization method which forms a polymer material capsule wall is preferably used. In the interfacial polymerization method, an oil phase is prepared by dissolving or dispersing a diazonium salt compound (and electron donating dye precursor) which are color developing components, in an organic solvent that is liquatious or insoluble in water. This mixture is then mixed together with an aqueous phase, including a water-soluble polymer dissolved therein, and the resulting mixture is emulsion-dispersed by means of a homogenizer or the like. Afterwards, by increasing the temperature, a polymer forming reaction occurs at the interface of the oil drops. This interfacial polymerization method can form capsules of uniform particle size in a short time period, and can obtain a recording material with excellent raw stock storability.

Examples of the aforementioned organic solvent include low-boiling point auxiliary solvents such as an acetate, methylene chloride and cyclohexanone and/or phosphate, phthalate, acrylate, methacrylate, other carboxylates, fatty acid amide, alkylated biphenyl, alkylated terphenyl, alkylated naphthalene, diarylethane, chlorinated paraffin, alcoholic solvents, phenolic solvents, ether type solvents, monoolefin type solvents and epoxy type solvents.

Specific examples of the organic solvent include high-boiling point solvents such as tricresyl phosphate, trioctyl phosphate, octyldiphenyl phosphate, tricyclohexyl phosphate, dibutyl phthalate, dioctyl phthalate, phthalic acid dilaurate, dicyclohexyl phthalate, butyl olefinate, diethylene glycol benzoate, dioctyl sebacate, dibutyl sebacate, dioctyl adipate, trioctyl trimellitate, acetyltriethyl citrate, octyl maleate, dibutyl maleate, isoamylbiphenyl, chlorinated paraffin, diisopropylnaphthalene, 1,1'-ditolylethane, 2,4-ditertiaryamylphenol, N,N-dibutyl-2-butoxy-5-tertiaryoctylaniline, 2-ethylhexyl hydroxybenzoate and polyethylene glycol.

Among these solvents, alcoholic solvents, phosphate type solvents, carboxylate type solvents, alkylated biphenyls, alkylatedterphenyls, alkylatednaphthalenes and diarylethane are particularly preferable.

Further, an anti-carbonizing agent such as a hindered phenol and a hindered amine may be added to the high-boiling point solvent. Examples of the high-boiling point solvent are α-methylstyrene dimers, and high-boiling point solvents having unsaturated fatty acids are particularly desirable. Specific examples of the α-methylstyrene dimer include "MSD100" manufactured by Mitsui Toatsu Chemicals.

Example of the aforementioned water-soluble polymer is polyvinyl alcohol. Specific examples of water-soluble polymer include polyvinyl alcohol, silanol-modified polyvinyl alcohol, carboxy-modified polyvinyl alcohol, amino-modified polyvinyl alcohol, itaconic acid-modified polyvinyl alcohol, styrene-maleic acid anhydride copolymers, butadiene-maleic acid anhydride copolymers, ethylene-maleic acid anhydride copolymers, isobutylene-maleic acid anhydride copolymers, polyacrylamide, polystyrenesulfonic acid, polyvinylpyrrolidone, ethylene-acrylic acid copolymers and gelatins. Among these compounds, carboxy-modified polyvinyl alcohol is preferable.

The aforementioned water-soluble polymers may be used together with hydrophobic polymer emulsions or latexes and the like. Examples of the emulsions or latexes are styrene-butadiene copolymers, carboxy-modified styrene-butadiene copolymers and acrylonitrile-butadiene copolymers. At this time, a conventionally known surfactant and the like may be added according to the need.

Examples of the polymer material forming a microcapsule wall include polyurethane resins, polyurea resins, polyamide resins, polyester resins, polycarbonate resins, aminoaldehyde resins, melamine resins, polystyrene resins, styrene-acrylate copolymer resins, styrene-methacrylate copolymer resins, gelatins and polyvinyl alcohol. Among these compounds, polyurethane and polyurea resins are particularly preferable.

When, for instance, a polyurethane and/or polyurea resin is used as a capsule wall material, a microcapsule wall precursor such as a polyvalent isocyanate is mixed in an oil-based medium (oil phase) encapsulated and become a core material. A second material (e.g., polyol or polyamine) which reacts with the microcapsule wall precursor to form a capsule wall is mixed in an aqueous water-soluble polymer solution (water phase). After the oil phase is emulsion-dispersed in the water phase, the emulsion dispersion is heated to cause a polymer-forming reaction at the interface of oil droplets, whereby a microcapsule wall can be formed.

Specific examples of the aforementioned polyvalent isocyanate compound are shown below, but the polyvalent isocyanate is not limited to these examples. The examples include diisocyanates such as m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-diphenylmethane-4,4'-diisocyanate, xylene-1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate and cyclohexylene-1,4-diisocyanate; triisocyanates such as 4,4',4"-triphenylmethane triisocyanate and toluene-2,4,6-triisocyanate; tetraisocyanates such as 4,4'-dimethylphenylmethane-2,2',5,5'-tetraisocyanate; and isocyanate prepolymers such as an adduct of hexamethylene diisocyanate and trimethylpropane, adduct of 2,4-tolylene diisocyanate and trimethylolpropane, adduct of xylylene diisocyanate and trimethylolpropane and adduct of tolylene diisocyanate and hexanetriol.

Two or more types may be used together according to the need. Among these compounds, those having three or more isocyanate groups in the molecule are particularly preferable.

In the microcapsulation method, the organic solvent used to dissolve the coupler (and the electron-acceptable compound), the organic base, the other components such as the sensitizer, the microcapsule wall precursor and the second material which reacts with the precursor are the same as the aforementioned organic solvents.

The particle diameter of the microcapsule is preferably 0.1 to 1.0 μm and more preferably 0.2 to 0.7 μm.

Next, specific embodiments of the structure of a multicolor recording material will be explained.

The heat-sensitive recording material of the present invention may be either a monocolor heat-sensitive recording material having one heat-sensitive recording layer on a support or a multicolor heat-sensitive recording material having a heat-sensitive recording layer with a laminate structure in which multiple monocolor recording layers are laminated on a support. In a preferable embodiment of the multicolor heat-sensitive recording material, at least one layer among the layers constituting the heat-sensitive recording layer is a photo-fixable type recording layer which comprises the diazonium salt compound and the coupler which reacts with the diazonium salt compound to develop a color.

In the case of, particularly, a full color heat-sensitive recording layer comprising cyan, yellow and magenta, a heat-sensitive recording material having a structure in which three layers on a support all comprise a diazo type color developing agent or a structure in which a first heat-sensitive recording layer close to a support comprises a leuco type color developing agent containing an electron-donating dye and an electron-acceptable compound and a second and a third heat-sensitive layer comprise a diazo type color developing agent is preferable.

For example, the heat-sensitive recording material may have structures shown by the following (a) to (c):

(a) A recording material which comprises a recording layer prepared by laminating a photo-fixable type recording layer (first recording layer (A layer)) having a diazonium salt compound with a maximum absorption wavelength of 360±20 nm and a coupler which reacts with the diazonium salt compound to develop a color and a photo-fixable type recording layer (second recording layer (B layer)) having a diazonium salt compound with a maximum absorption wavelength of 400±20 nm and a coupler which reacts with the diazonium salt compound to develop a color, on a support, and which recording material is also provided with a light-transmittance adjusting layer on the recording layer and a protective layer on the light-transmittable adjusting layer according to the need.

(b) A recording material which comprises a recording layer prepared by laminating a recording layer (first recording layer (A layer)) including an electron-donating dye and an electron-acceptable compound, a photo-fixable type recording layer (second recording layer (B layer)) having a diazonium salt compound with a maximum absorption wavelength of 360±20 nm and a coupler which reacts with the diazonium salt compound to develop a color and a photo-fixable type recording layer (third recording layer (C layer))having a diazonium salt compound with a maximum absorption wavelength of 400±20 nm and a coupler which reacts with the diazonium salt compound to develop a color, in this order on a support, and which recording material is also provided with a light-transmittance adjusting layer on the recording layer and a protective layer on the light-transmittable adjusting layer according to the need.

(c) A recording material which comprises a recording layer prepared by laminating a photo-fixable type recording layer (first recording layer (A layer)) having a diazonium salt compound with a maximum absorption wavelength of 340±20 nm and a coupler which reacts with the diazonium salt compound to develop a color, a photo-fixable type recording layer (second recording layer (B layer)) having a diazonium salt compound with a maximum absorption wavelength of 360±20 nm and a coupler which reacts with the diazonium salt compound to develop a color and a photo-fixable type recording layer (third recording layer (C layer)) having a diazonium salt compound with a maximum absorption wavelength of 400±20 nm and a coupler which reacts with the diazonium salt compound to develop a color, in this order on a support, and which recording material is also provided with a light-transmittance adjusting layer on the recording layer and a protective layer on the light-transmittance adjusting layer according to the need.

A multicolor recording method will be explained hereinbelow in the case of using the above (b) or (c).

First, the third recording layer (C layer) is heated to cause the diazonium salt and coupler contained in this layer to develop a color. Next, light having a wavelength of 400±20 nm is applied to decompose and photo-fix the unreacted diazonium salt compound contained in the C layer and thereafter heat sufficient to make the second recording layer (B layer) develop a color is applied, causing the diazonium salt and coupler included in this layer to develop a color. Even though, the C layer is simultaneously being strongly heated, the C layer develops no color since the diazonium salt compound has been already decomposed (photo-fixed) and therefore has lost its color developing ability. Further, light having a wavelength of 360±20 nm is applied to decompose and photo-fix the diazonium salt compound contained in the B layer and thereafter, heat sufficient to make the first recording layer (A layer) develop a color is applied to develop a color. Even though, the C layer and the B layer are simultaneously being strongly heated at the same time, these layers develop no color since the diazonium salt compounds have already decomposed and hence have lost their color developing abilities.

As to the order of the lamination of each layer, it is useful to dispose the yellow layer having low visibility as the lowermost layer particularly in the case of improving image qualities because an adverse influence, caused by the roughness of the surface of the support, on image qualities can be decreased.

When all the recording layers (A layer, B layer and C layer) are diazo type recording layers, it is necessary to photo-fix the A layer and B layer after color is developed. However, the C layer in which an image is recorded last does not necessarily need to be photo-fixed. However, the C layer is preferably photo-fixed from the view point of improving the storage stability of the formed image.

A fixation light source used for photo-fixation may be properly selected from known light sources. Examples of these known light sources include various fluorescent lamps, xenon lamps and mercury lamps. Among these light sources, a light source whose emission spectrum substantially agrees with an absorption spectrum of the diazonium salt compound used in the recording material is preferable, from the view point of highly efficient photo-fixation.

Other Layers

The heat-sensitive recording material of the present invention preferably has a structure provided with a light-transmittance adjusting layer in addition to a single heat-sensitive recording layer or multiple heat-sensitive recording layers on the support. Further, as required, an intermediate layer may be formed, and a back layer may be formed on the side of the support opposite to the side on which the heat-sensitive recording layer is formed.

Light-transmittance Adjusting Layer

The light-transmittance adjusting layer includes a ultraviolet absorber precursor, which does not function as a ultraviolet absorber before light having a wavelength range required for fixation is applied. Therefore, the light-transmittance adjusting layer has a high transmittance, and when the photo-fixable type heat-sensitive recording layer is to be fixed, the transmittance of light having the wavelength range required for fixation is sufficient. Moreover, the transmittance of visible light is also high, which does not hinder the fixation of heat-sensitive recording layer. This ultraviolet absorber precursor is preferably contained in a microcapsule.

Examples of compounds to be contained in the light transmittance adjusting layer are described in the official gazette of JP-A No. 9-1928.

After completion of irradiation with light of the wavelength range required for fixation, the above ultraviolet absorber precursor is reacted by light, heat or the like, and comes to function as the ultraviolet absorber. Then, the majority of the light having a ultraviolet wavelength range required for the fixation is absorbed by the ultraviolet absorber and as a result, the transmittance decreases and the light resistance of the heat-sensitive recording material improves. However, because the ultraviolet absorber does not effectively absorb visible rays, the transmittance for visible rays does not substantially change.

At least one light-transmittance adjusting layer may be formed in the heat-sensitive recording material. It is most desirable that the light-transmittance adjusting layer be formed between a heat-sensitive recording layer and an outermost protective layer. The light-transmittance adjusting layer may also be used as the protective layer. The characteristics of the light transmittance adjusting layer may be arbitrarily selected to correspond to the characteristics of the heat-sensitive recording layer.

A coating solution for forming the light transmittance adjusting layer is obtained by mixing each of the aforementioned components. The coating solution for a light transmittance adjusting layer can be coated using a known coating means such as a bar coater, an air knife coater, a blade coater or a curtain coater to form the light transmittance adjusting layer. The light transmittance adjusting layer may be coated and formed while simultaneously forming the heat-sensitive recording layer by coating. Also, for example, once a coating solution for forming a heat-sensitive recording layer is coated and the heat-sensitive recording layer is dried, the light transmittance adjusting layer may be formed on the recording layer.

Intermediate Layer

When multiple heat-sensitive recording layers are laminated, an intermediate layer is preferably interposed between each heat-sensitive recording layer. Like the protective layer, the intermediate layer may contain various binders and also, a pigment, lubricant, surfactant, dispersant, fluorescent whitening agent, metal soap, ultraviolet absorber and the like. As the above binder, the same binder that is used in the protective layer may be used.

Support

Examples of the above support include: polyester films such as polyethylene terephthalates and polybutylene terephthalates; cellulose derivative films such as cellulose triacetate films; synthetic polymer films such as polyolefin films including polystyrene films, polypropylene films, polyethylene films, polyimide films, polyvinyl chloride films, polyvinylidene chloride films, polyacrylic acid copolymers and polycarbonate films; paper; synthetic paper and paper having a plastic resin layer.

The above support may be used singly or as a combination of the two or more.

As the paper with a plastic resin layer, a paper product prepared by forming a layer containing a thermoplastic resin on both surfaces of base paper or on at least the side on which the heat-sensitive recording layer is to be formed is desirable. Examples of these supports include: (i) those prepared by coating the base paper with the thermoplastic resin by melt-extrusion; (ii) those prepared by applying a gas barrier layer above the thermoplastic resin applied to the base paper by melt-extrusion; (iii) those prepared by bonding a plastic film having low oxygen permeability to the base paper; (iv) those prepared by disposing the thermoplastic resin formed by melt-extrusion onto the surface of a plastic film bonded to the base paper; and (v) those prepared by bonding a plastic film to the thermoplastic resin after the thermoplastic resin is applied to the base paper by melt extrusion.

As the aforementioned thermoplastic resin to be applied to the base paper by melt extrusion, olefin resins, for example, homopolymers of $\alpha$-olefins such as polyethylene and polypropylene and mixtures of these various polymers and random copolymers of ethylene and vinyl alcohol are preferable. Examples of the polyethylene include LDPE (low density polyethylene), HDPE (high density polyethylene) and L-LDPE (linear low density polyethylene).

As a method for applying a plastic film to the base paper, a proper one may be selected from known lamination methods described in "NEW LAMINATE PROCESSING HANDBOOK" (edited by The Society for Processing Technology Research) Preferable methods include so-called dry lamination, non-solvent type dry lamination, dry lamination using an electron ray- or ultraviolet-curable resin and hot dry lamination.

Among the aforementioned various supports, a paper support in which at least one surface of the base paper is laminated with polyethylene is preferable. The polyethylene is usually laminated on the side where the heat-sensitive recording layer is formed. A paper support obtained by laminating polyethylene on both surfaces of the base paper is more preferable. In this case, polyethylene is laminated on the side on which the heat sensitive recording layer is formed for the purpose of improving flatness, and on the opposite side for the purpose of controlling curl evenness.

The above synthetic polymer film may be colored in an optional hue. Examples of a method of coloring a polymer film include (i) a method in which a dye is pre-kneaded into a resin prior to the formation of a film and the resin containing the dye is formed into a film and (ii) a method in which a coating solution prepared by dissolving a dye in a proper solvent is applied to a transparent colorless resin film by using a known coating method, for example, a gravure coating method, roller coating method or wire coating method, and dried. Among these, in preferable method, blue dye is kneaded into a polyester resin, such as polyethylene terephthalate or polyethylene naphthalate, which is formed into a film-shape. To this film-shaped resin is applied a heat resistance treatment, a drawing treatment, and an anti-static treatment.

The thickness of the support is preferably 25 to 300 $\mu$m and more preferably 50 to 250 $\mu$m.

The aforementioned heat-sensitive recording layer, protective layer, light-transmittance adjusting layer and intermediate layer may be formed on the support by using a known coating method such as a blade coating method, air-knife coating method, gravure coating method, roll coating method, spray coating method, dip coating method or bar coating method, followed by drying.

EXAMPLES

The present invention will be explained in more detail by way of examples, which are not intended to limit the present invention. Hereinafter, designations of parts and % denote parts by weight and weight percentage (wt. %), respectively, and occasionally the diazonium salt compound is simply called a diazo compound.

Example 1

(1) Production of a Support

Wood pulp comprising 100 parts of LBKP was beaten to a Canadian freeness of 300 ml by a double disk refiner. 0.5 parts of epoxidized behenic acid amide, 1.0 part of anionic polyacrylamide, 0.1 parts of polyamidopolyamineepichlorohydrin and 0.5 parts of cationic polyacrylamide were added to the beaten pulp wherein each amount was a bone dry mass ratio relative to the pulp, to make base paper having an areal weight of 100 g/m by a Fourdrinier paper machine. The base paper was surface-sized using polyvinyl alcohol 1.0 g/m in bone dry mass and a density of the base paper was adjusted to 1.0 g/m by a calendering treatment.

After the wire side (reverse side) of the above base paper was subjected to corona discharge treatment, it was coated with high density polyethylene using a melt-extruder to form a resin layer with a thickness of 30 $\mu$m and comprising a matt surface (this surface is called a reverse side). The reverse side polyethylene coated surface was subjected to corona discharge treatment. Thereafter aluminum oxide ("Alumina Sol 100", manufactured by Nissan Chemical Industries) and silicon dioxide "Snowtex O", manufactured by Nissan Chemical Industries at a ½ weight ratio which were dispersed in water was applied to the reverse side in an amount by weight of 0.2 g/m$^2$ after being dried (this product is called a reverse side PE laminated product).

The felt side (front surface) of the base paper was subjected to corona discharge treatment and was then coated with low density polyethylene comprising 10 wt % of titanium dioxide and a small amount of ultramarine blue by melt-extrusion using a melt-extruder to form a resin layer of 40 $\mu$m thickness and having a gloss surface (this surface is called a front surface). The polyethylene coated front surface was subjected to corona discharge treatment.

(2) Preparation of an Undercoat Layer Solution 97.5 parts by weight of water was added to 2.5 parts by weight of swelling synthetic mica "ME100" (manufactured by Cope Chemical) to disperse the mica by using a dyna-mill. The mixture was added to 200 g of an aqueous 5 wt % gelatin solution kept at 40° C., and stirred for 30 minutes. 20 ml of the following surfactant-1 (5 wt %) was added to the resulting solution to form an undercoat layer solution.

Surfactant-1

Surfactant-1

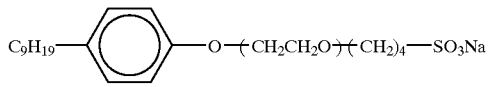

(3) Preparation of a Cyan Heat-sensitive Recording Layer Solution

Preparation of a Capsule Solution Containing an Electron-Donating Dye Precursor (i) Solution A 5 parts of 3-(o-methyl-p-dimethylaminophenyl)-3-(1'-ethyl-2'-methylindole-3-yl)phthalide (electron-donating dye precursor) was dissolved in 20 parts of ethyl acetate. Then, 20 parts of alkylnaphthalene (high-boiling point solvent) was added to this mixture, heated and uniformly mixed.

20 parts of a ⅓ adduct of xylylenediisocyanate and trimethylol propane was added to the resulting solution and this mixture was uniformly stirred to prepare a solution A.

(ii) Solution B 2 parts of an aqueous 2 wt % sodium dodecylsulfonate was added to 54 parts of an aqueous 6 wt % phthalated gelatin to prepare a solution B.

The solution A was added to the solution B and this mixture was emulsion-dispersed using a homogenizer to obtain an emulsion-dispersion. 68 parts of water was added to the resulting emulsion-dispersion and mixed uniformly. Thereafter the mixed solution was heated to 50° C. while stirring to run a capsulation reaction for 3 hours to obtain a capsule solution having microcapsules with an average particle diameter of 1.2 $\mu$m.

Preparation of a Developer Emulsion Dispersion 2.5 parts of 1,1-(p-hydroxyphenyl)-2-ethylhexane (developer), 0.3 parts of tricresyl phosphate and 0.1 parts of diethyl maleate were dissolved in 10 parts of ethyl acetate. The resulting solution was poured into a solution of 20 parts of an aqueous 6 wt % gelatin solution mixed with 2 parts of an aqueous 2 wt % sodium dodecylsulfonate solution and emulsified using a homogenizer for 10 minutes to obtain an emulsion-dispersion.

Preparation of Coating Solutions (4) Preparation of a Magenta Heat-sensitive Recording Layer Solution Preparation of a Capsule Solution Containing a Diazo Compound 2.0 parts of a diazo compound (1) (decomposed by light having a wavelength of 365 nm) represented by the following structural formula was dissolved in 20 parts of ethyl acetate and thereafter 20 parts of alkylnaphthalene was further added to the mixture, which was then heated and evenly mixed. 15 parts of a ⅓ adduct of xylylenediisocyanate and trimethylol propane (capsule wall agent) was added to the resulting solution, which was then uniformly mixed to obtain a diazo compound solution.

The resulting diazo compound solution was added to a solution of 54 parts of an aqueous 6 wt % phthalated gelatin solution mixed with 2 parts of an aqueous 2 wt % sodium dodecylsulfonate solution and this mixture was then emulsion-dispersed using a homogenizer.

68 parts of water was added to the resulting emulsion-dispersion and mixed uniformly. The dispersion was heated to 40° C. while stirring to run a capsulation reaction for 3 hours to obtain a capsule solution having particles with an average particle diameter of 1.2 $\mu$m.

Diazo compound (1)

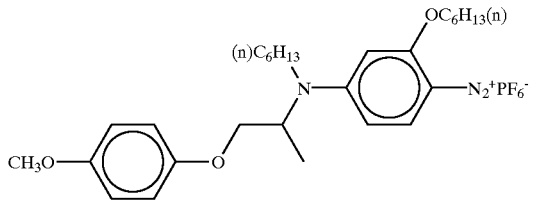

Preparation of a Coupler Emulsion-dispersion 2 parts of the following coupler, 2 parts of 1,2,3-triphenylguanidine, 0.3 parts of tricresyl phosphate and 0.1 parts of diethyl maleate were dissolved in 10 parts of ethyl acetate. The resulting solution was poured into an aqueous solution of 20 parts of an aqueous 6% gelatin solution mixed with 2 parts of an aqueous 2% sodium dodecylsulfonate solution and then emulsified for 10 minutes by using a homogenizer to obtain a coupler emulsion-dispersion.

Coupler (1)

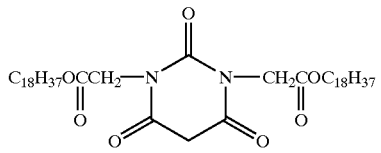

Preparation of a Coating Solution

SBR latex ("SN-307", manufactured by Sumitomo Nogatac) was added to the previously prepared capsule solution comprising the diazo compound in an amount of 40 wt % based on the capsule solid content. Then, the coupler emulsion was mixed into the capsule solution containing the diazo compound in a ratio by amount of 3/2 to obtain a coating solution for a magenta layer.

(5) Preparation of a Yellow Heat-sensitive Recording Layer Solution

Preparation of a Capsule Solution Containing a Diazo Compound 3.0 parts of 2,5-dibutoxy-4-tolylthiobenzenediazoniumhexafluorophosphate (diazo compound: decomposed by light having a wavelength of 420 nm) was dissolved in 20 parts of ethyl acetate. Afterwards, 20 parts of alkylnaphthalene was added to the mixture as a high-boiling point solvent, and this mixture was heated and mixed uniformly.

15 parts of a ⅓ adduct of xylylenediisocyanate and trimethylol propane was added to the resulting solution as a capsule wall agent, followed by mixing uniformity to obtain a diazo compound solution.

This diazo compound solution was added to a solution of 54 parts of an aqueous 6 wt % phthalated gelatin solution mixed with 2 parts of an aqueous 2 wt % sodium dodecylsulfonate solution and the resulting solution was then emulsion-dispersed using a homogenizer. 68 parts of water was added to the resulting emulsion-dispersion and uniformly mixed. The uniformly mixed solution was then further heated to 40° C. while being stirred to run a capsulation reaction for 3 hours to obtain a capsule solution with an average particle diameter of 1.3 μm.

Preparation of a Coupler Emulsion-dispersion 2 parts of 2-chloro-5-(3-(2,4-di-tert-pentyl) phenoxypropylamino)acetoacetoanilide, 1 part of 1,2,3-triphenylguanidine, 0.3 parts of tricresyl phosphate and 0.1 parts of diethyl maleate were dissolved in 10 parts of ethyl acetate. The resulting solution was poured into an aqueous solution of 20 parts of an aqueous 6% gelatin solution mixed with 2 parts of an aqueous 2% sodium dodecylsulfonate solution; and was then emulsified for 10 minutes using a homogenizer to obtain an emulsion-dispersion.

Preparation of a Coating Solution

The coupler emulsion-dispersion which was prepared previously was mixed with the capsule solution containing the diazo compound in a ratio by amount of 3/2 to obtain a coating solution for a yellow layer.

(6) Preparation of an Intermediate Layer Solution 3 parts of an aqueous 15 wt % polyacrylic acid (Trademark: "Julymer AC-10L", manufactured by Nippon Junyaku Kabushiki Kaisha) solution was added to 10 parts of an aqueous 15 wt % gelatin (Trademark: "#750", manufactured by Nitta Gelatin Kabushiki Kaisha) solution and the resulting solution was uniformly mixed to obtain an intermediate layer solution.

(7) Preparation of a Coating Solution for a Light-transmittance Adjusting Layer 1.5 parts of a compound shown below, 0.5 parts of R-6 as a reducing agent, 6.0 parts of ethyl acetate and 0.8 parts of tricresyl phosphate were mixed together and sufficiently dissolved. 3.0 parts of xylylenediisocyanate/trimethylolpropane (75% ethyl acetate solution, "Takenate D110N", manufactured by Takeda Chemical Industries) was added to this solution and the mixture was stirred uniformly. 29.7 parts of an aqueous 8 wt % carboxy-modified polyvinyl alcohol ("KL-318", manufactured by Kuraray) solution was prepared and added to the above solution, followed by emulsion-dispersing using a homogenizer. The resulting emulsion was added to 40 parts of ion exchange water and this mixture was stirred at 40° C. for 3 hours to run a capsulation reaction. After that, 7.0 parts of an ion exchange resin "Amberlite MB-03" (manufactured by Organo) was added to the reaction product, followed by stirring for another hour. The target coating solution was thus prepared. The average particle diameter of the capsules was 0.35 μm.

R-6

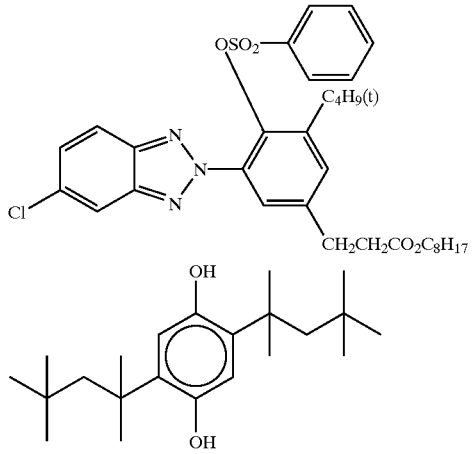

(8) Preparation of a Protective Layer Solution

| | |
|---|---|
| EP130 (7 wt %) | 100 g |
| Water | 50 g |
| Barifine BF21 dispersion (20 wt %) | 10 g |
| Surfactant-1 (2 wt %) | 5 ml |
| Surfactant-2 (5 wt %, methanol solution) | 5 ml |

Here, "EP130" was dodecyl-modified polyvinyl alcohol manufactured by Denki Kagaku Kogyo and "Barifine BF21 dispersion" was barium sulfate microparticles manufactured by Sakai Chemical Industry. In addition, the above surfactant-2 was Dainol 604 manufactured by Airproducts Japan.

(9) Production of a Heat-sensitive Recording Material

The solutions were coated on the front side of the polyethylene-laminated paper support in the following order: undercoat layer solution, cyan heat-sensitive recording layer solution, intermediate layer solution, magenta heat-sensitive recording layer solution, intermediate layer solution, yellow heat-sensitive recording layer solution, light-transmittance adjusting layer solution, and protective layer solution. The solutions were then dried to obtain a multicolor heat-sensitive recording material 100.

The amounts of each layer, converted to solid parts to be applied were as follows in the order of layers closer to the support: undercoat layer: 1.0 g/m$^2$ cyan heat-sensitive recording layer: 6.1 g/m$^2$, intermediate layer: 1.0 g/m$^2$, magenta heat-sensitive recording layer: 7.8 g/m$^2$, intermediate layer: 1.0 g/m$^2$, yellow heat-sensitive recording layer: 7.2 g/m$^2$, light-transmittance adjusting layer: 1.5 g/m$^2$ and protective layer: 1.2 g/m$^2$.

Example 2

A heat-sensitive recording material was produced in the same manner as in Example 1 except that the surfactant-2 was replaced by Surfinol 104E (10% methanol solution, manufactured by Nisshin Kagaku Kogyo Kabushiki Kaisha).

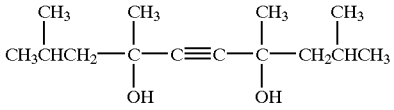

Example 3

A heat-sensitive recording material was produced in the same manner as in Example 1 except that the amount of the surfactant-2 was changed to 2 ml.

Comparative Example 1

A heat-sensitive recording material was produced in the same manner as in Example 1 except that the surfactant-2 was replaced by a 5 wt % methanol solution of a surfactant having the following structural formula.

Surfactant-2

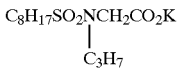

Comparative Example 2

A heat-sensitive recording material was produced in the same manner as in Comparative Example 1 except that the amount of the surfactant-2 was changed to 10 ml.

Comparative Example 3

A heat-sensitive recording material was produced in the same manner as in Comparative Example 1 except that the amount of the surfactant-2 was changed to 2 ml.

Evaluation

Five A4-sized sheets of heat-sensitive recording material were produced according to each of the Examples and Comparative Examples. Then the sheets were visually inspected, and the number of surface defects (coating nonuniformities) was counted. The results are shown in Table 1.

TABLE 1

| | Number of surface defects |
|---|---|
| Example 1 | 0 |
| Example 2 | 0 |
| Example 3 | 0 |
| Comparative Example 1 | 2 |

TABLE 1-continued

| | Number of surface defects |
|---|---|
| Comparative Example 2 | 2 |
| Comparative Example 3 | 2 |

It can be seen Table 1 that the heat-sensitive recording materials obtained in the Examples are different from those obtained in the Comparative Examples in that coating nonuniformities do not occur.

What is claimed is:

1. A heat-sensitive recording material comprising a heat-sensitive recording layer and a protective layer on a support, wherein the protective layer contains an acetylene glycol represented by the following formula (1):

Formula (1)

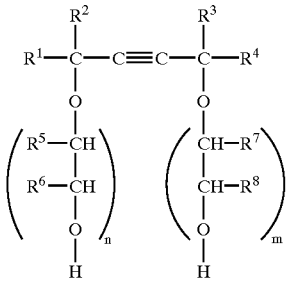

Wherein: $R^1$ to $R^4$ respectively represents a hydrogen atom, a branched, straight-chain or cyclic unsubstituted or substituted alkyl group having 1 to 8 carbon atoms or an unsubstituted or substituted aryl group having 6 to 10 carbon atoms; $R^5$ to $R^8$ respectively represents a hydrogen atom or a methyl group; and n and m independently denotes an integer from 0 to 50.

2. A heat-sensitive recording material according to claim 1, wherein $R^2$ and $R^3$ respectively represents a methyl group, $R^1$ and $R^4$ respectively represents an isobutyl group and n and m respectively denotes 0.

3. A heat-sensitive recording material according to claim 1, wherein n and m respectively denotes 0 to 4.

4. A heat-sensitive recording material according to claim 1, wherein the acetylene glycol is selected from the group consisting of compounds represented by the following structural formula.

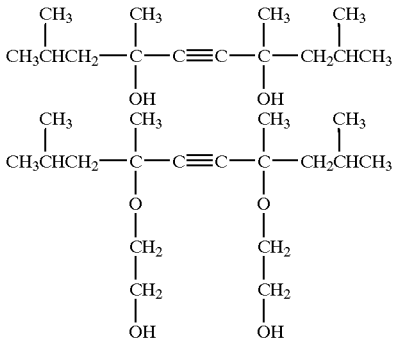

-continued

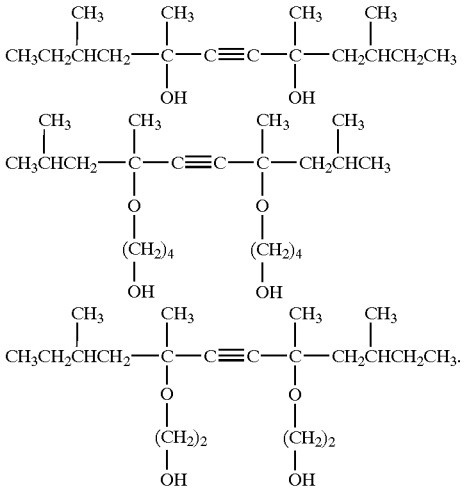

5. A heat-sensitive recording material according to claim 4, wherein the protective layer further contains a binder.

6. A heat-sensitive recording material according to claim 5, wherein the binder is dodecyl-modified polyvinyl alcohol.

7. A heat-sensitive recording material according to claim 6, wherein the protective layer further contains barium sulfate.

8. A heat-sensitive recording material according to claim 5, wherein the protective layer further contains a pigment.

9. A heat-sensitive recording material according to claim 1, wherein the acetylene glycol is the following compound:

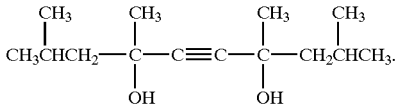

10. A heat-sensitive recording material according to claim 9, wherein the protective layer further contains a binder.

11. A heat-sensitive recording material according to claim 10, wherein the binder is dodecyl-modified polyvinyl alcohol.

12. A heat-sensitive recording material according to claim 11, wherein the protective layer further contains barium sulfate.

13. A heat-sensitive recording material according to claim 10, wherein the protective layer further contains a pigment.

14. A heat-sensitive recording material according to claim 1, wherein the protective layer further contains a binder.

15. A heat-sensitive recording material according to claim 14, wherein the binder is dodecyl-modified polyvinyl alcohol.

16. A heat-sensitive recording material according to claim 15, wherein the protective layer further contains barium sulfate.

17. A heat-sensitive recording material according to claim 14, wherein the protective layer further contains a pigment.

* * * * *